US007854402B1

(12) United States Patent
Travis

(10) Patent No.: US 7,854,402 B1
(45) Date of Patent: Dec. 21, 2010

(54) HYDRAULIC SYSTEM VALVING

(76) Inventor: Tonny D. Travis, P.O. Box 217, Prosperity, WV (US) 25909

( * ) Notice: Subject to any disclaimer, the term of this patent is extended or adjusted under 35 U.S.C. 154(b) by 265 days.

(21) Appl. No.: 12/287,818

(22) Filed: Oct. 14, 2008

Related U.S. Application Data

(63) Continuation of application No. 12/154,576, filed on May 23, 2008, now abandoned.

(60) Provisional application No. 60/997,221, filed on Oct. 2, 2007.

(51) Int. Cl.
*E01C 19/20* (2006.01)
*A01C 17/00* (2006.01)
*B65F 3/00* (2006.01)

(52) U.S. Cl. ..... 239/673; 239/661; 239/675; 239/676; 239/682; 239/687; 239/689; 414/517

(58) Field of Classification Search ..... 239/671, 239/672, 673, 680, 664, 682, 687, 661, 681, 239/689, 676, 675; 118/305, 312, 313, 315; 222/252, 254, 272, 273, 330, 331, 334; 280/490 R; 298/1 C; 414/495, 497, 517; 415/27, 17; 364/431.02
See application file for complete search history.

(56) References Cited

U.S. PATENT DOCUMENTS 4,673,131 A * 6/1987 Travis ..... 239/673
5,306,116 A * 4/1994 Gunn et al. ..... 415/27
6,732,791 B2 * 5/2004 Buysse et al. ..... 165/279
7,053,498 B1 * 5/2006 Boisvert et al. ..... 290/40 R

* cited by examiner

*Primary Examiner*—Len Tran
*Assistant Examiner*—Justin Jonaitis

(57) ABSTRACT

A mine dusting machine having a specialized scoop constructed with a floor, opposite sides and ends and adapted for carrying substantially free-flowing particulate material, a powered ram on the scoop for pushing the material therein toward the front end of the scoop, a hydraulic motor powered auger conveyor mounted on the scoop adjacent said front end for transporting the material toward opposite sides of the scoop, separate material flingers mounted on said front end at least adjacent each of the sides and being hydraulically motor powered to receive the material transported thereto by the conveyor and then dispersing the material with considerable force in a generally arcuate pattern in a mine, wherein the motors are hydraulically connected in series to a pressurized hydraulic feed line and wherein each motor has a case drain port, a hydraulic return line connecting the last flinger motor of the series to a PTO, a primary check valve in the return line for preventing reverse flow therein, a motor case drain line connected into each case drain port of the series and connected into the return line upstream of the primary check valve, and a secondary check valve in the drain line intermediate its conjunction with the return line and the last of the flinger motors of the series for preventing over pressurization of the motor cases in the event of an operator caused accidental momentary reverse "HP" flow thru the primary, check valve which has become partially blocked open by dirt particles or the like in the hydraulic fluid.

5 Claims, 10 Drawing Sheets

FIG. 1
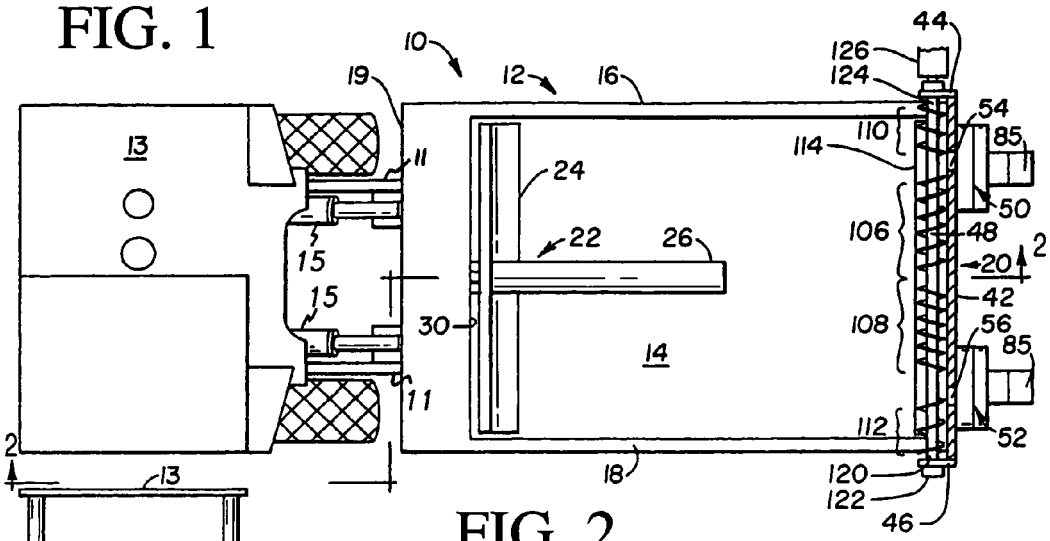
FIG. 2
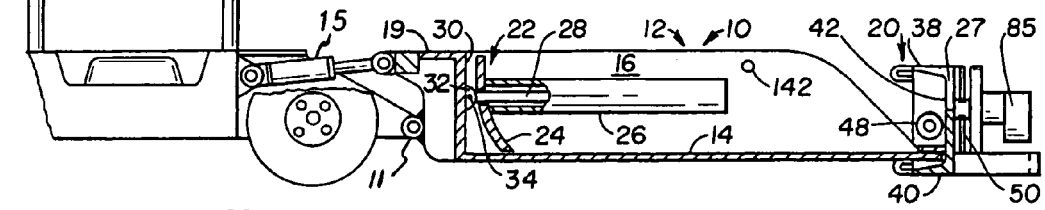
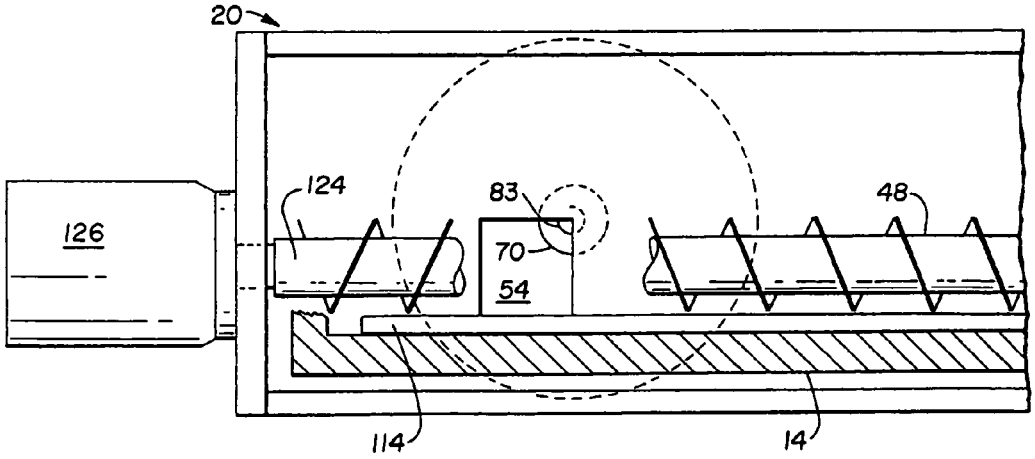
FIG. 3

FIG. 4
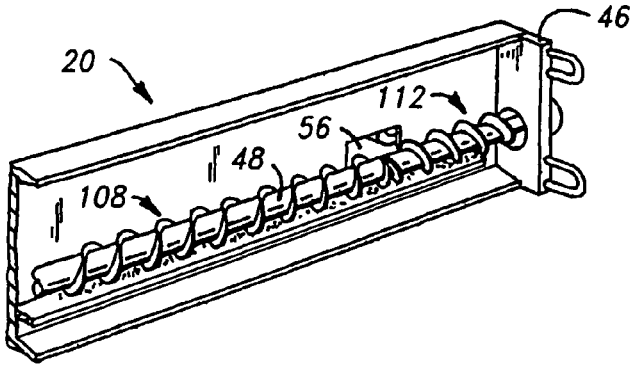
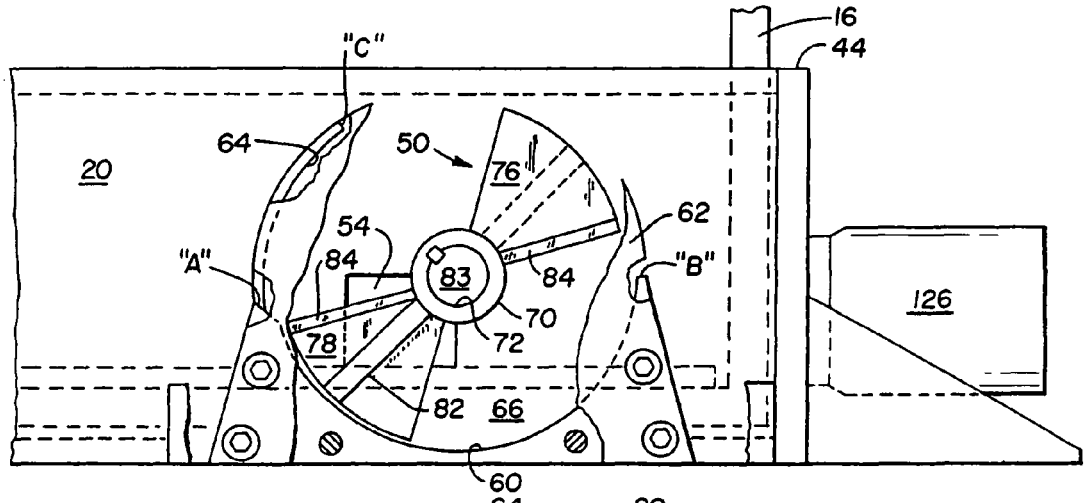
FIG. 5
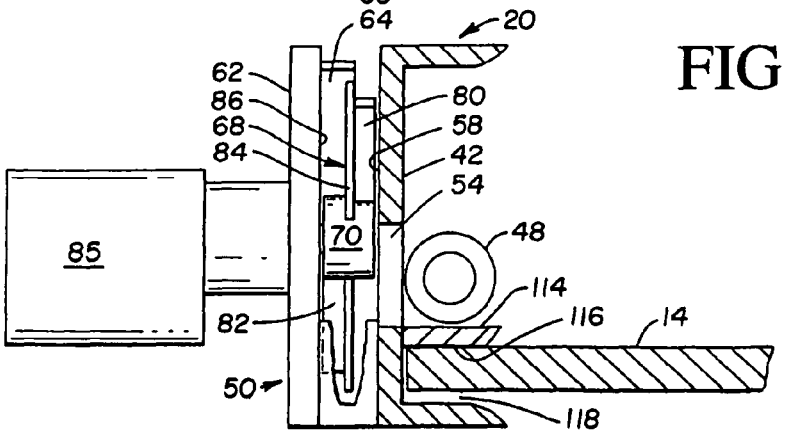
FIG. 6

FIG. 7
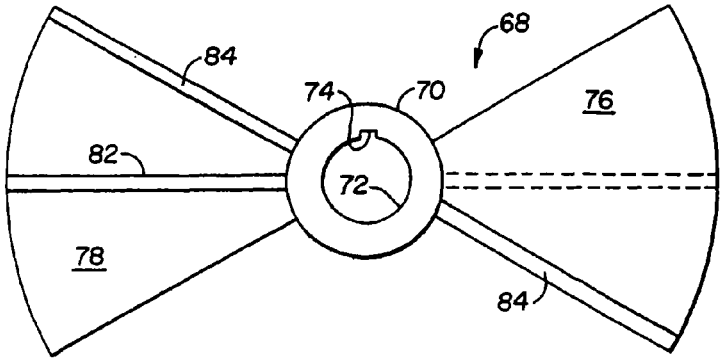
FIG. 10
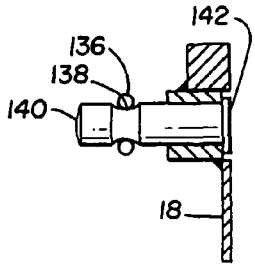
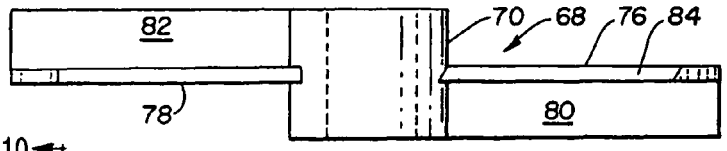
FIG. 8
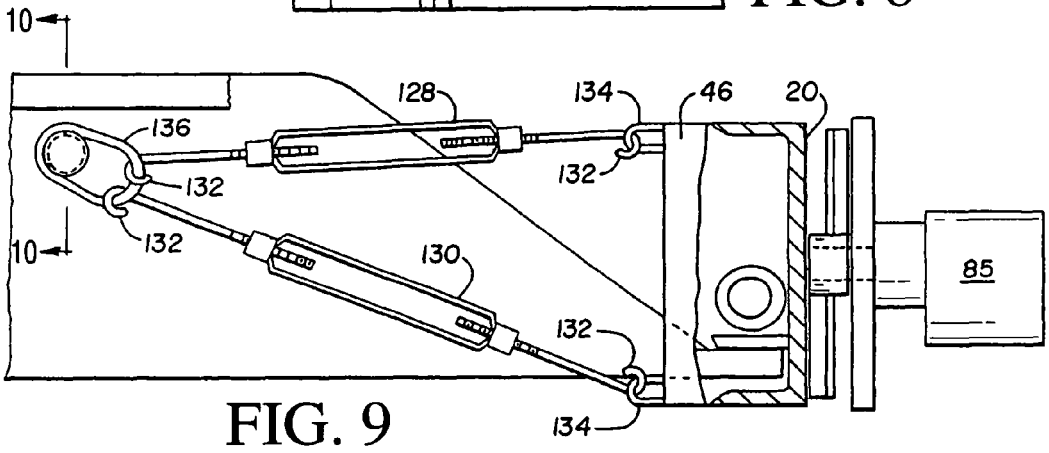
FIG. 9
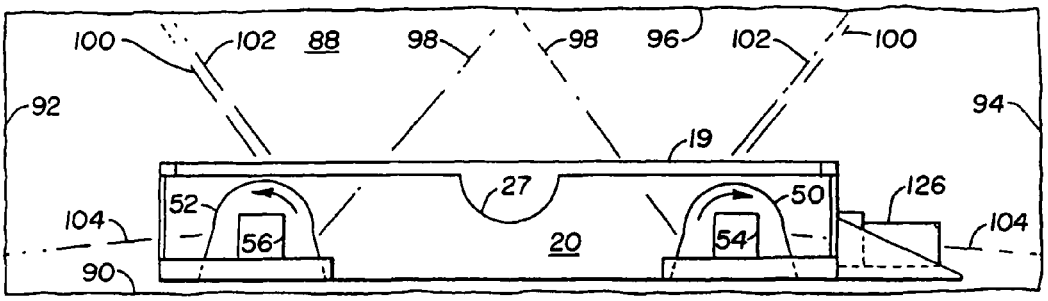
FIG. 11

Specifications
- Parallel or series circuit construction

Pressure rating
- Maximum operating - 3000 psi
- Maximum tank pressure - 500 psi
- Nominal Flow rating - 12 GPM (FIG-2)

PRIOR ART (FIG-4)
PRIOR ART (FIG-6)
PRIOR ART (FIG-3A)
PRIOR ART (FIG-5)
PRIOR ART

EXTERNAL GEAR

DIRECT-DRIVE GEROTOR

ORBITING GEROTOR

ROLLER-VANE GEROTOR

The Tubing Check Valve-Flared is a three piece constructed valve with 37° flared ends which conforms to J.I.C. and S.A.E. Hydraulic Standards. These valves are designed for maximum flow with minimal pressure drop.

FIG. 24
PRIOR ART
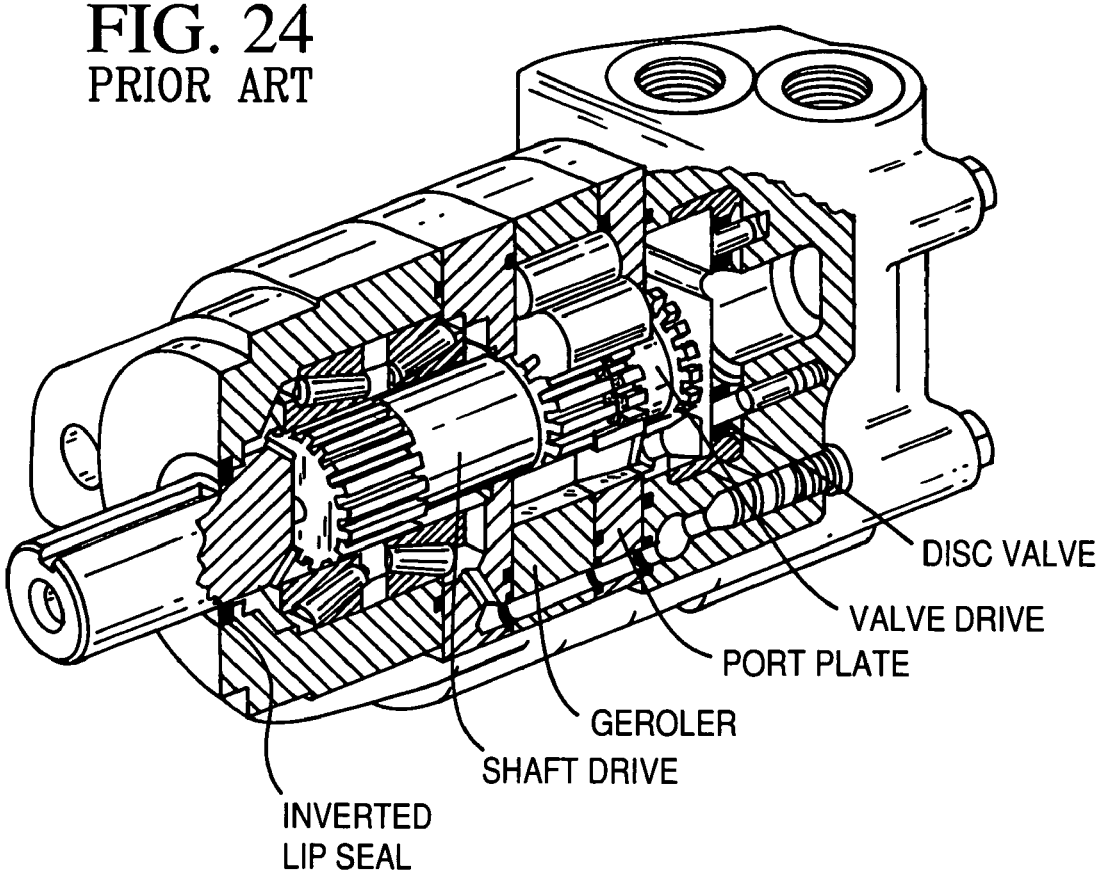
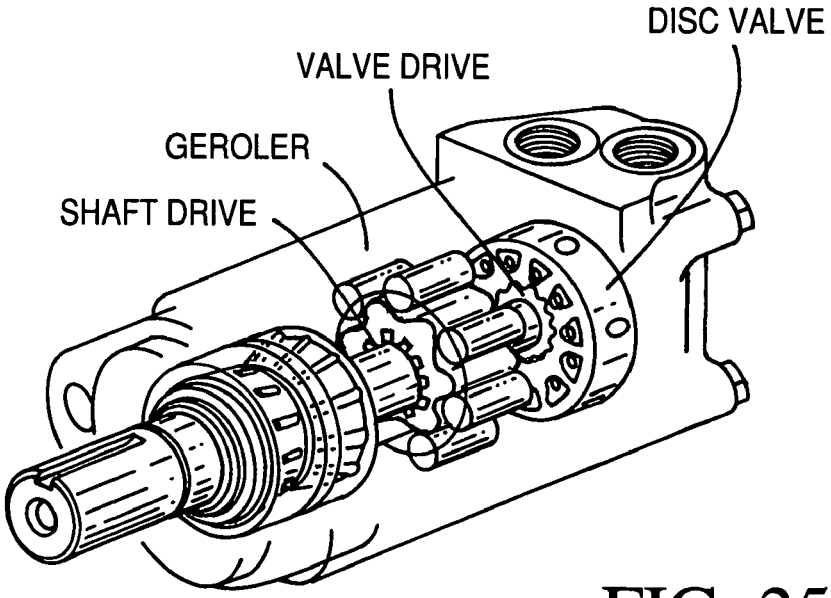
FIG. 25
PRIOR ART

HYDRAULIC SYSTEM VALVING

BACKGROUND OF THE INVENTION

This application claims priority under 35 U.S.C. 119(c)(1) based on Applicants Provisional U.S. patent application Ser. No. 60/997,221 filed Oct. 2, 2007 and titled "HYDRAULIC SYSTEM VALVING", and is a continuing application of Applicants application Ser. No. 12/154,576 filed May 23, 2008 now abandoned of same title.

1. Field

This invention is directed to improvements in hydraulic systems and particularly in the hydraulic systems of mining equipment motors which are typically constructed with a sealed case containing a power unit designed to operate under high pressure, e.g., several hundred psi, and which converts hydraulic force into mechanical motion to drive an output shaft rotatably mounted thru the case wall and thru an annular shaft seal affixed in the wall. The power unit is typically isolated from the case in semi-sealed housing structure which is designed to allow a small leakage (slippage) of hydraulic oil from the power unit thru the housing structure and into the case to thereby lubricate moving parts of the power unit such as meshing gears, pistons, wobble plates, output shaft mounting bearings, wear plates or the like. Of particular concern herein is the prevention of rapid, excessive hydraulic pressure build-up within the motor cases to an extent, e.g., 1500-2500 psi, depending on the pressure relief or by-pass valve setting in the directional control valve, which excessive pressure "blows out" the motor shaft seals and brings the mine dusting or other operation to a halt. The motor cases normally are under much lower pressures such as, for example, 20-50 psi which is also the pressure normally felt at the shaft seal.

The invention is particularly useful on dusting machines which are designed for dispersing large quantities of particulate material into the atmosphere, and particularly concerns such machines which disperse rock dust in coal mines to put down a layer of dust on the mine floor, ribs and roofs to settle coal dust and to minimize the dangers of explosion, for example, from coal dust and/or methane.

2. Prior Art

Such motors are usually bi-directionally operable and function in extremely grimy environments such as exists in underground coal mines which are not only filled with coal dust but which are daily dusted with rock dust for suppressing coal dust, gases or other dangerous materials. Such operating conditions make it practically impossible to keep the hydraulic fluid which run the motors in a clean condition and the consequent dirty, gritty hydraulic fluid results in excessive wear of the motor parts, locking up of hydraulic motors, clogging of hydraulic lines and prevention of proper closing of pressure regulating check valves or the like, all of which can contribute, to one extent or another, to an uncontrolled spontaneous rise in oil pressure within the motor case resulting in destruction of the motor shaft seal.

It is common practice to provide a motor which is used on the aforesaid mining equipment with some form of oil drain system for the motor case such that the case and shaft seal cannot be over pressurized. One form of drain system, for example, comprises the use of a case drain line which connects the case to the return line. In using a bi-directional motor, when the feed and return are reversed, a case drain valve provided by the manufacture within the motor case will reverse the drain line to the return line. However, when, as in applicants mine dusting machine described herein in detail, the motors are hydraulically connected in series from auger motor at high operating (line 144) P (e.g., 800-1000 psi), to 1$^{st}$ flinger motor at lower operating (line 144A) P (e.g., 500 psi), to 2$^{nd}$ flinger motor at still lower operating (line 144B) P (e.g., 250 psi), the bi-directional capability of the motor cannot be utilized since the flinger motors, especially their shaft seals, are not designed to operate under PTO pressure which would result from the reversal of the feed and return lines in a conventional system. Consequently, conventional case drain check valve systems cannot be used in applicants system.

Typical hydraulic motors to which the present invention is applicable include all types having a sealed output shaft such as gear (external, internal, lobe), direct drive gerotor, orbiting gerotor, roller-vane gerotor, vane balanced, and the like. Patents which show some of these types, the disclosures of which patents are hereby incorporated herein by reference in their entireties include U.S. Pat. Nos.: 6,481,990 B2; 4,981,423; 3,593,621; 2,463,950; 2,478,481; 3,619,093; 4,466,336; 4,578,020; and 4,551,080. Additionally, U.S. Patent Office Search Class 415 "Rotary Kinetic Fluid Motors Or Pumps" contain hundreds of patents further showing hydraulic motors for which the present invention is useful. Examples of such motors are given in the drawings herein and denoted "PRIOR ART".

Further in this regard and as a primary cause of spontaneous over pressurization of the motor case and shaft seal, operation of hydraulic equipment is typically done thru operator manipulation of lever operable directional control valves (FIG. 12B) which can deliver high pressure fluid thru either a feed line or a return line, as desired, and which is mounted on the mining equipment such as a mine utility tractor. Such a control lever, for example, when pivoted forward will run a motor in one direction and when pivoted backward will run the motor in the reverse direction such as to run a hydraulically wheeled vehicle or auxiliary mining equipment thereon forwards or backwards. Typical of these vehicles are the various types of utility tractors, coal scoops, continuous miners, shuttle cars, ram cars, bolt machines and the like.

As will become apparent below, and contrary in its operation to many of the hydraulic systems of present mining machines and equipment which operators are called upon to run, an unintentional pressurization of the return line (LP) of applicants present hydraulic system by the operator for more than a few seconds in his testing of the hydraulics of applicants machine or his inadvertent manipulation of the control lever in the wrong direction would have a disastrous effect on applicants motor shaft seals.

Applicants "Mine Dusting Machine", U.S. Pat. No. 4,673,131, the disclosure of which is incorporated herein below, describes a machine commonly used to spread limestone dust in undergound coal mines. This machine receives power from a hydraulic power take-off (PTO) that is on an underground mining machine called a scoop which carries a large amount of rock dust to be spread throughout the mine to suppress coal dust and other explosive materials. The scoop's hydraulic PTO is bi-directional, i.e., either the hydraulic feed line or the return line (hoses) may be used as high pressure (HP) or low return pressure (LP) as required since the PTO can be used with a variety of auxiliary devices and mining apparatus which require such bi-directional operation, i.e., forward and reverse operation.

Three hydraulic motors are commonly used on the "Mine Dusting Machine" and are hosed in series as shown in FIGS. 1 and 12. As further elaboration to prior systems mentioned above, bi-directional hydraulic motors are the ones readily available and by-pass or leak hydraulic oil internally into the motor case from their power units which typically comprise some form of an armature means or other hydraulically driven structure mounted within a semi-sealed housing which is in turn sealed in a motor case. The leakage goes thru the power unit and provides lubrication its to various parts and to the output shaft bearings. The leaked oil within the case is at very low pressure compared to the feed pressure. If, for example, such a hydraulic motor runs alone, the leaked oil in the case is typically ported to the hydraulic reservoir tank, which is at low pressure, by use of a drain system employing internal check valves within the case. The case drain collects the leaked oil and the internal check valves prevent excessive back pressure from developing on and disrupting, i.e., blowing out the shaft seal. However, if the motors are hydraulically connected in series as in the present system these factory installed internal check valves cannot be to prevent excessive back pressures from developing, in the motor cases since the downstream subsequent motor feed lines must be pressurized to run the downstream motors of the series.

The Mine Dusting Machine's auger motor, preferably of the Geroler® type (see FIGS. 24 and 25), is the first hydraulic motor in the series and is of such a design that its output shaft seal will withstand several hundred, e.g., 500-1,000 psi of hydraulic back pressure within the motor case without damage to the shaft seal. The second and third hydraulic motors, preferably of the meshing gear type (see FIG. 23), are used to power the flingers and are of such a design that the output shaft seals can only withstand about 60 psi without their disruption. At a higher pressure the shaft seals will be turned wrong side out—blown out—and will subsequently leak hydraulic oil, even at lower pressure as illustrated in FIGS. 13 and 14 at a sufficient rate to shut the motor down and drain the hydraulic system.

It is noted that these preferred output shaft seals, as shown in FIGS. 13, 14, 16 and 23 are termed herein as "inverted lip seals" and are constructed with one or more elastomeric annular discs having an annular shaft contact lip "L" which is pressured by an annular spring and/or the oil pressure within the motor case sealingly against the shaft. These discs can take a variety of configurations but the provision of an inverted lip is highly preferred. As the hydraulic oil becomes dirty with various types of grit and other particulate solids, the abrasiveness of the solids will wear the seal and make it easier for case pressure to disrupt the seal. Other type seals including O-ring or stuffing box types can also be blown out by excessive pressures.

These factors cause to exist the further and ever present possibility of the scoop operator pivoting the control lever in the wrong direction and throwing full hydraulic pressure, e.g., 2500 psi internally of the motor casings and thus blowing out the seals. It is noted that in the operation of hydraulic machines in general, the operator will generally test the hydraulic operation by pivoting the hydraulic levers to their forward and reverse positions by force of habit. In such a situation wherein a mine dusting machine such as applicants is being used without the protection afforded by applicants present drain system, the pressurization (HP) of the return line by mistake could be very costly.

SUMMARY OF THE INVENTION

In a machine having a "HP" feed line and a "LP" return line from and to a hydraulic PTO and series connected number of hydraulic motors for operating auxiliary equipment, and having a primary check valve in a return line for preventing reverse flow therein, a motor case drain line connected into each case of the series and connected into the return line upstream of the primary check valve, and a secondary check valve in the drain line intermediate its conjunction with the return line and the last motor of the series for preventing over pressurization of the motor cases in the event of an accidental momentary reverse "HP" flow thru the primary check valve is blocked open by particulates in the hydraulic fluid.

It is noted, with respect to the above summary, that the secondary check valve is of utmost importance since it prevents any accidental reverse flow of "HP" fluid in the return line from entering the drain line and immediately over pressurizing the motor cases and shaft seals. In this regard, should a reverse flow occur solely in the return line, the high pressurization resulting in the power unit housings will not cause a destructive hydraulic slippage into the motor cases at such a rate that the operator cannot comprehend that the motors are running in reverse and thus prevent him from correcting the situation in time to prevent shaft seal blow-out.

BRIEF DESCRIPTION OF THE DRAWINGS

The invention will be understood further from the following description and drawings wherein:

FIG. 1 is a top view of the present specialized hopper including a portion of the front of a mine utility tractor supporting the hopper;

FIG. 2 is an overall side view, substantially in section, of the hopper of FIG. 1;

FIG. 3 is an enlarged view of the helical auger means and its mounting adjacent to the inside of the flinger beam (front end) of the hopper;

FIG. 4 is an isometric view of a portion of the inside of the flinger beam with portions broken away for clarity;

FIG. 5 is a partially sectional view of the front of the flinger beam showing the relative positions of the flingers, their housings and their feed ports;

FIG. 6 is a side view, partially in section, of the flinger beam showing the flinger in detail;

FIG. 7 is front elevational view of a preferred flinger blade;

FIG. 8 is an edge or side view of the blade of FIG. 7;

FIG. 9 is a partially sectional side view of the hopper showing an embodiment of the means for detachably attaching the flinger beam to the floor and sides;

FIG. 10 is a partially sectional view of a unique attaching pin for holding the flinger beam in place;

FIG. 11 is a schematic view of the inside of the flinger beam as viewed looking into a typical coal mine with the approximate dust dispersing pattern shown by dotted lines;

FIGS. 24 and 25 are cutaways of a Geroler® hydraulic motor.

DETAILED DESCRIPTION

Figure 12:
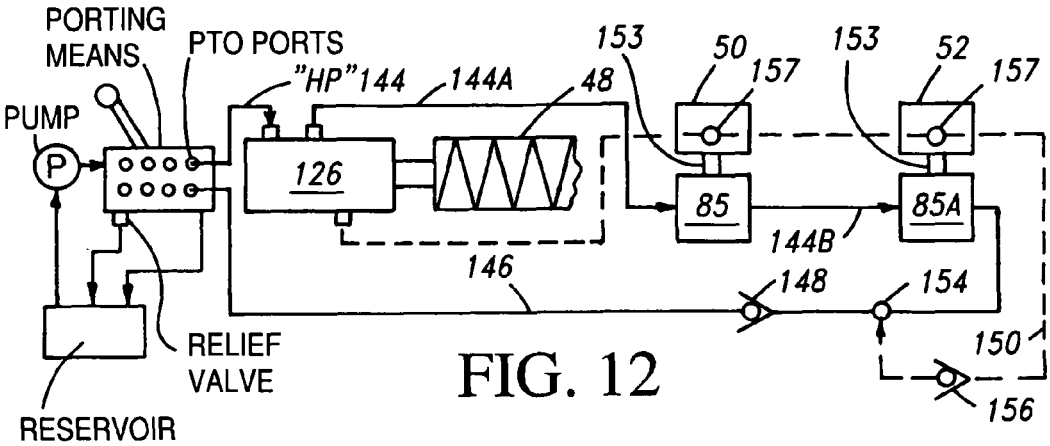
FIG. 12 is a schematic representation of the present hydraulic system.
Figure 12A:
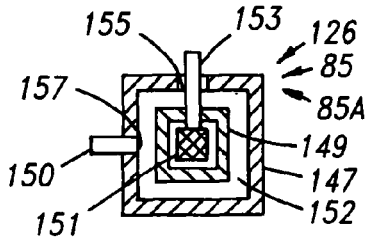
FIG. 12A is a cross-sectional schematic of typical hydraulic motors.

Referring to the drawings, FIG. 1 shows a partially schematic top view of the present dusting machine (generally termed "scoop" in the mining trade) generally designated 10 comprising a hopper or scoop bucket generally designated 12 and a mine utility tractor 13 attached thereto. A general type of "scoop" to which the present invention is related is manufactured, for example, by the S & S Equipment Co., Richlands, Va. Model 482. The present hopper comprises floor 14, port side 16, starboard side 18, rear end 19 and the entirely novel front end or flinger beam 20. A powered ram means generally designated 22 is positioned in the hopper for moving (feeding) the rock dust toward the flinger beam and comprises in the embodiment shown, a pusher 24 resembling the form of a bulldozer blade having affixed to the front thereof a hydraulic cylinder 26 having its piston 28 passing through the pusher and affixed to the inner wall 30 of rear end 19 by means of a clevis 32 and pin 34, or by any other convenient means including threading the end of shaft 28 directly into wall 30 or by welding the shaft thereto. The cylinder 26 is preferably sufficiently long to allow pusher 24 to move substantially the full length of hopper 12.

It is not necessary to provide special roller or skid means on the bottom edge and/or ends of pusher 24 to allow a smoother motion thereof, however, such expedient is desirable, especially for large hoppers and pushers. The particular powered ran means shown may, of course, be varied greatly and could comprise, for example, hydraulic, electrical or air operated screw drivers or winch drives positioned on the inside or outside of the hopper at each end of the pusher by mechanisms well known to the art. A non-preferred, but operable means to feed the dust to the hopper front could comprise lengthwise oriented auger means, but such a feeding mechanism would be much less efficient and convenient than the pusher shown. I have found, however, that the powered ram construction shown is a most efficient mechanism.

Referring to FIGS. 1-8, the novel flinger or dust dispersing mechanism of the present invention comprises the flinger beam 20 which carries essential components of the present invention and is constructed, in the embodiment shown, to allow rapid and easy assembly, defined in detail below, to the forward portions of a scoop bucket or hopper such as is used in coal mines for various utility purposes. This beam, conveniently shown in the present embodiment as a modified steel channel beam or bar, comprises sides 38 and 40, web 42, end pieces or auger bearings 44 and 46, auger 48, flingers 50 and 52 (any convenient number of such flingers may be used, however), and dust feed ports 54 and 56 opening through web 42.

For ease of understanding of the present invention, and prior to giving further details thereof, suffice it to say at this point that pusher 24, through the actuation of dual actuated cylinder 26, pushes the rock dust onto auger 48 which transmits it into and through ports 54 and 56 to flingers 50 and 52 respectively which throw it upwardly and outwardly in a predetermined pattern to "dust" the ceiling, ribs (walls) and floor of the mine entry. As the pusher approaches its forward limit, cylinder 26 passes through cut-out 27 in beam 20.

As aforesaid, ports 54 and 56 communicate with the flingers, each of which has a housing shown in the present embodiment as consisting of a front surface portion 58 of web 42, an interior arcuate wall 60, a front cover 62, and a dust shield 64, all of which provide a dust pick-up basin or reservoir generally designated 66. Mounted within each basin 66 is blade means generally designated 68, which, as shown in the particular embodiment of the drawings, comprises a hub 70 having a shaft bore 72 and keyway 74 and plate means affixed to said hub and comprising angularly opposed segments 76 and 78 carrying blades 80 and 82 respectively, welded, formed, or otherwise affixed to the segments. Shaft means 83 connects the blade means to a motor 85 which is geared to rotate the blade means clockwise in FIG. 5 at about 1,000 to 3,000 rpm, preferably at about 1,500 to about 2,500 rpm. For purposes of this description with particular reference to FIG. 5, the flinger beam 28 is shown in front view and slightly elevated from the mine floor in normal operating position wherein the hopper may be moved progressively along the mine by tractor 13 during the dusting operation. Dotted lines 98 represent the inner pattern limit for dust dispersal by each of flingers 50 and 52 and is determined primarily by the height of point "A" of wall 60 of each flinger with respect to the axis of rotation of blade means 68. This inner pattern, point "A" and said axis are selected according to the particular distance prescribed between the flingers, the height of the shaft ceiling and the desired overlap, if any, of the inner pattern limit at the ceiling. It was found that an outer pattern limit was rapidly reached at about the position of dotted lines 100, long before the mine ribs were properly dusted. To overcome this problem, the unique blade means 68 and dust shield 64 shown in the drawings were devised whereby the dust output of the leading blade 82 of each flinger was blocked for a selected arc to give the inner pattern limits represented by dotted lines 102, which, in the embodiment shown, overlaps with the outer pattern limits 100 to insure full ceiling coverage. The outer pattern limits of blade 82 therefore, due to the delayed dust egress, become dotted lines 104 which reaches essentially the bottom of the mine ribs. These outer pattern limits are determined primarily by the height of point "B" relative to the said axis of rotation of blade means 68. It is apparent therefore, that depending on the width and height of the mine cross section, and the distance between the flingers, the dust dispersal pattern would have to be altered in order to provide full surface coverage. To this end, the height "C" of dust shield 64 and the height of "B" of surface 60 may be made readily adjustable by means known in the mechanical arts.

Referring to FIGS. 1 and 3, the novel auger 48 of the present invention comprises two primary sections of opposed helices 106 and 108 shown bracketed in FIG. 1, and adjacent reverse helical sections 110 and 112, also bracketed in FIG. 1. Underlying auger 48 is a ledge 114 which conveniently serves the dual function of retaining the rock dust in contact with the auger and also providing an upper wall 116 to form slot 118 (see FIG. 6) in cooperation with beam 20. This slot assists in retaining beam 20 on the hopper as described below in further detail. One end 120 of auger 48 is mounted in seal bearing means 122 in known manner, and the other end 124 is connected to a motor 126 for rotation thereby in a clockwise direction as viewed in FIGS. 4 and 6. It can readily be seen that as rock dust is pushed into contact with auger 48 it will be conveyed by both the primary sections 106 and 108 and their adjacent reverse sections 110 and 112, into the flinger feed ports 54 and 56 respectively. The auger drive motor 126 is preferably geared to rotate the auger at from about 500 to about 1,500 rpm, and most preferably at about 800 to about 1,200 rpm, but lower or higher rpm may be used, depending, for example, on the quantity and dispersal rate desired and the size of the auger and flinger blade means. It has been found that reverse sections 110 and 112 assist greatly in providing adequate feed to the flingers and in preventing dust build-up at the hopper sides with, attendant excessive pressure on the pusher 24. All of the motors 85 and 126 are preferably hydraulic, geared type, such as 3000 series PERMCO motors. Electrical, air or other motors may, of course, also be used.

Referring to FIGS. 5 and 10, one type of disconnect means for releasably attaching the flinger beam to the hopper is shown to comprise a pair of turnbuckles 128 and 130 at each end of beam 20 and having hooks 132 at each end for connecting into loops 134 welded to beam ends 44 and 46 on either side of the plane of the hopper floor, and to ring 136. This ring is mounted in groove 138 in pin 140 which is removably mounted in each of the hopper sides as shown in FIG. 10 with its inside end 142 flush with or recessed below the inner surface of the hopper side. In place of this form of disconnect means, various other tensioning mechanisms may be employed such as rachet and pawl, or the load binders (overcentering lever types) shown, for example, on page 339 of the McMaster-Carr Catalog No. 87, 1981.

Many variations of structure may, of course, be employed in the present invention as can be envisioned by one skilled in the art. For example, the plate means of blade means 68 may be a single circular disc having a single of multiple blades thereon, however, the present blade means offers the enormous improvement in dispersibility. Also, more than two flingers may be used, as well as multiple principal helical sections on the auger, or multiple augers could be employed should greater output be desired.

Figure 12B:
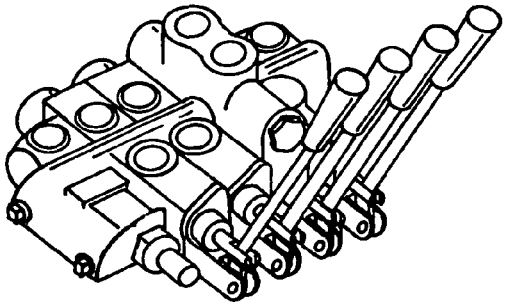
FIG. 12B PRIOR ART
FIG. 12B shows a typical multi-ported manually lever operated Directional Control Valve useful in the present system.

Referring to present FIGS. 12, 12A, 12B, 13, 14, 16 and 23 the present invention with further reference to the claims herein and to one preferred embodiment of the use of the present hydraulic system comprises powered equipment such as a mine utility tractor having hydraulic PTO powering capability comprising a hydraulic reservoir, hydraulic pump, a manually operated directional control valve such as shown, as an example in FIG. 12B having feed and return ports for either permanent or quick-connect coupling to auxiliary devices such as the present dusting machine which has a "H" feed line 144 and a "LP" return line 146 for coupling to said ports. The present hydraulic system comprises a series connected number of hydraulic motors such as 126, 85, and 85A for operating the present mine dusting machine and having a primary check valve 143 in the return line for preventing reverse flow therein. Each motor comprises a sealed case 147 forming a case cavity 152, a semi-sealed power unit housing 149 within said case, a hydraulically operated power unit 151 mounted within said housing, and an output shaft 153 from said power unit extending out thru a wall portion of said case and sealed thereto by an inverted lip seal means 155. A motor case drain line 150 is connected into each case cavity 152 at a drain port 157 therein and connected into the return line at a junction 154 upstream of the primary check valve. A secondary check valve 156 is provided in the drain line intermediate its conjunction 154 with the return line and the last motor of the series for preventing over pressurization of the motor cases in the event of an accidental momentary reverse "HP" flow thru the primary check valve which often becomes blocked open by particulates in the hydraulic fluid.

Figure 13:
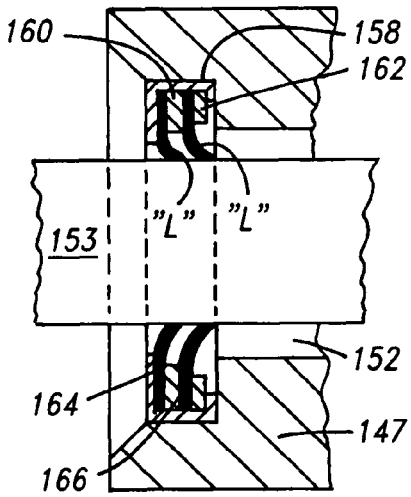
FIG. 13 is a cross-sectional view of a preferred "inverted lip seal" for use in applicants motors.
Figure 14:
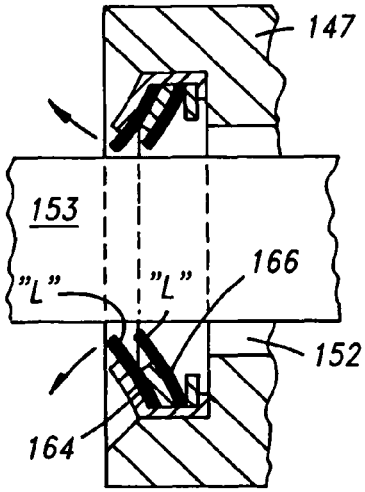
FIG. 14 is a cross-sectional view of the seal of FIG. 13 "blown out" by the application of PTO high pressure, e.g., 2500 lb/in$^2$ inadvertently directed by the machine operator to the return line.
Figure 15:
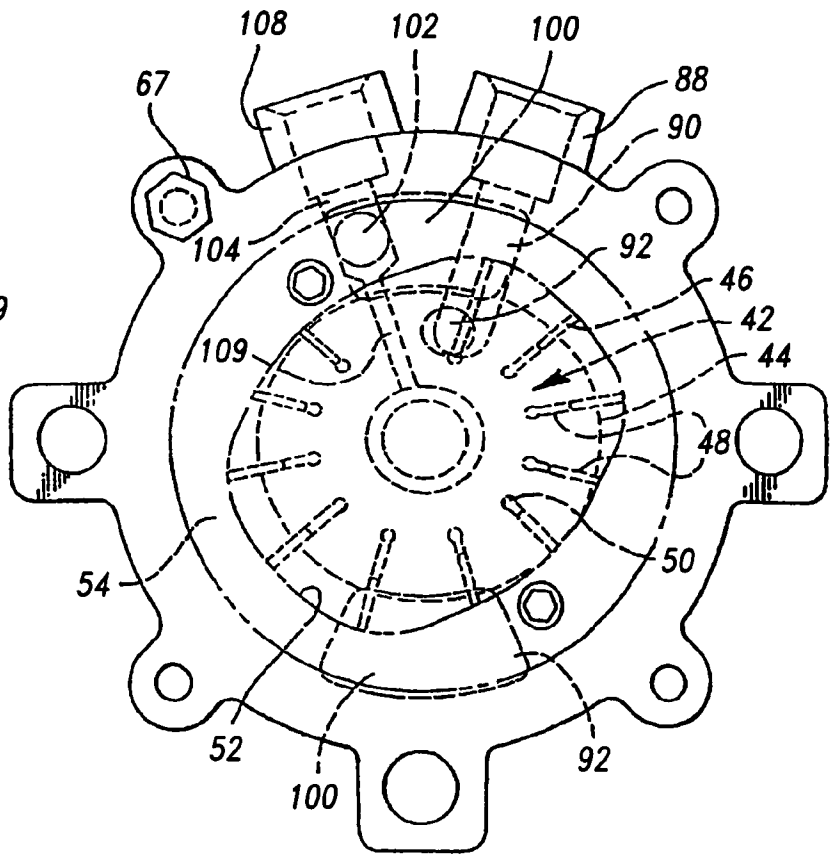
FIGS. 15 thru 20 are copies of FIGS. 2-6 respectively of U.S. Pat. No. 6,481,990 B2 showing a sliding vane type hydraulic motor having a form of "inverted lip seal" as used in hydraulic motors and denoted "PRIOR ART"
Figure 16:
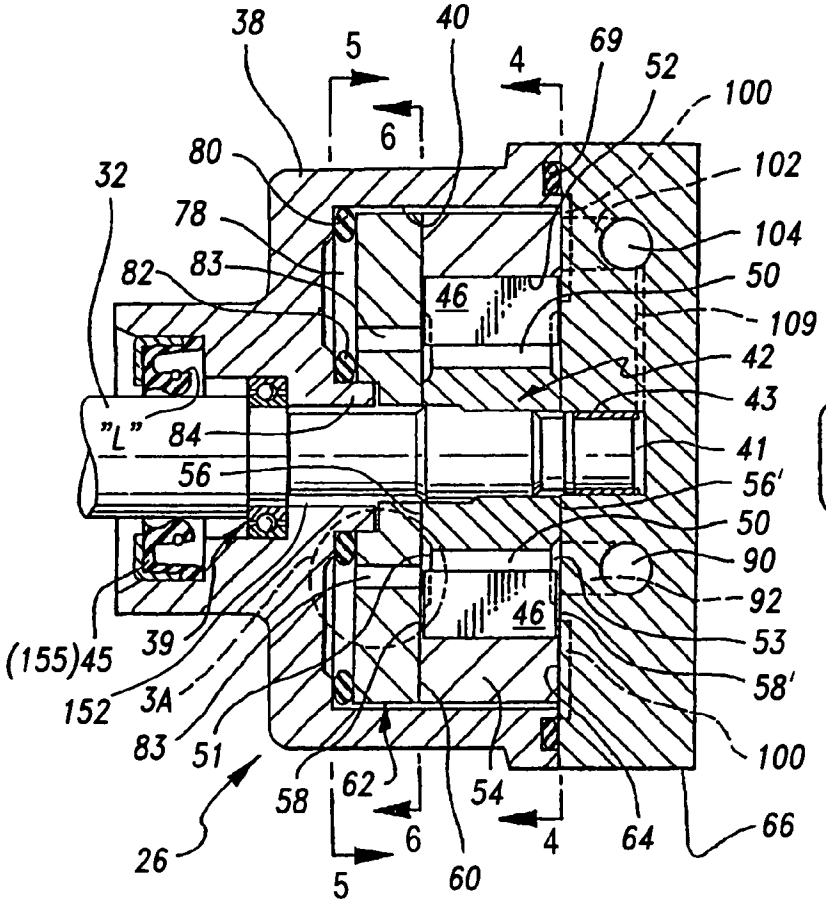
PRIOR ART FIG. 16
Figure 18:
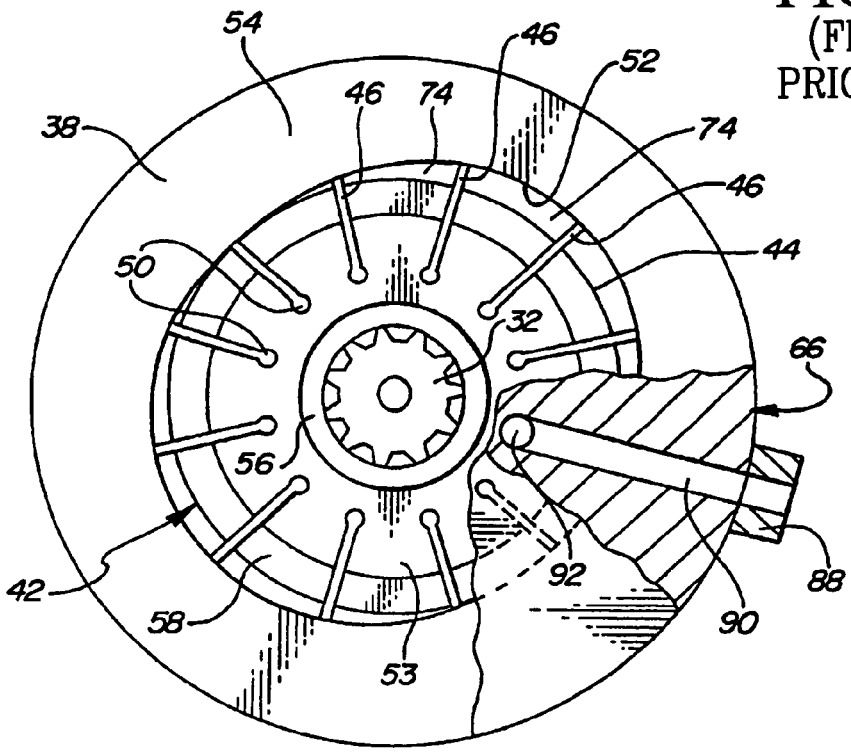
Figure 20:
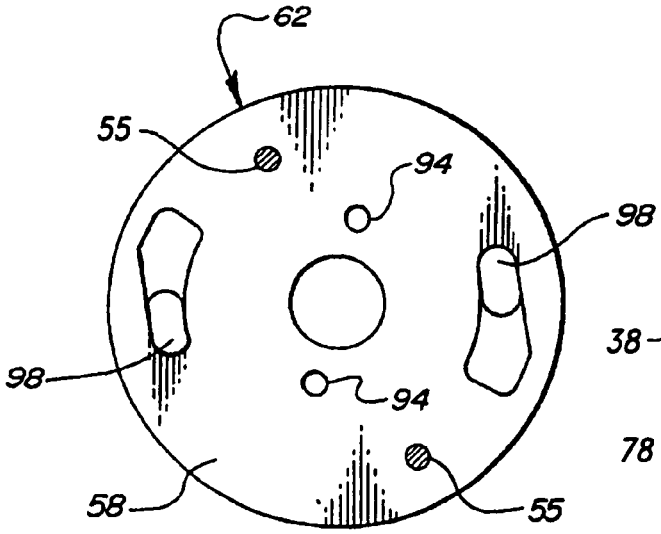
Figure 17:
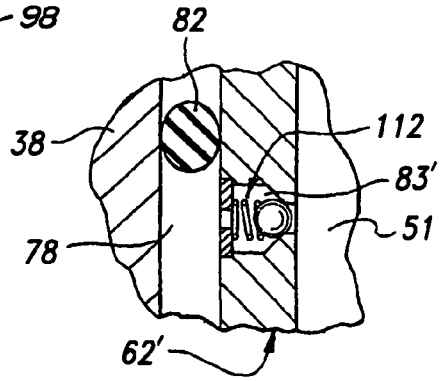
Figure 19:
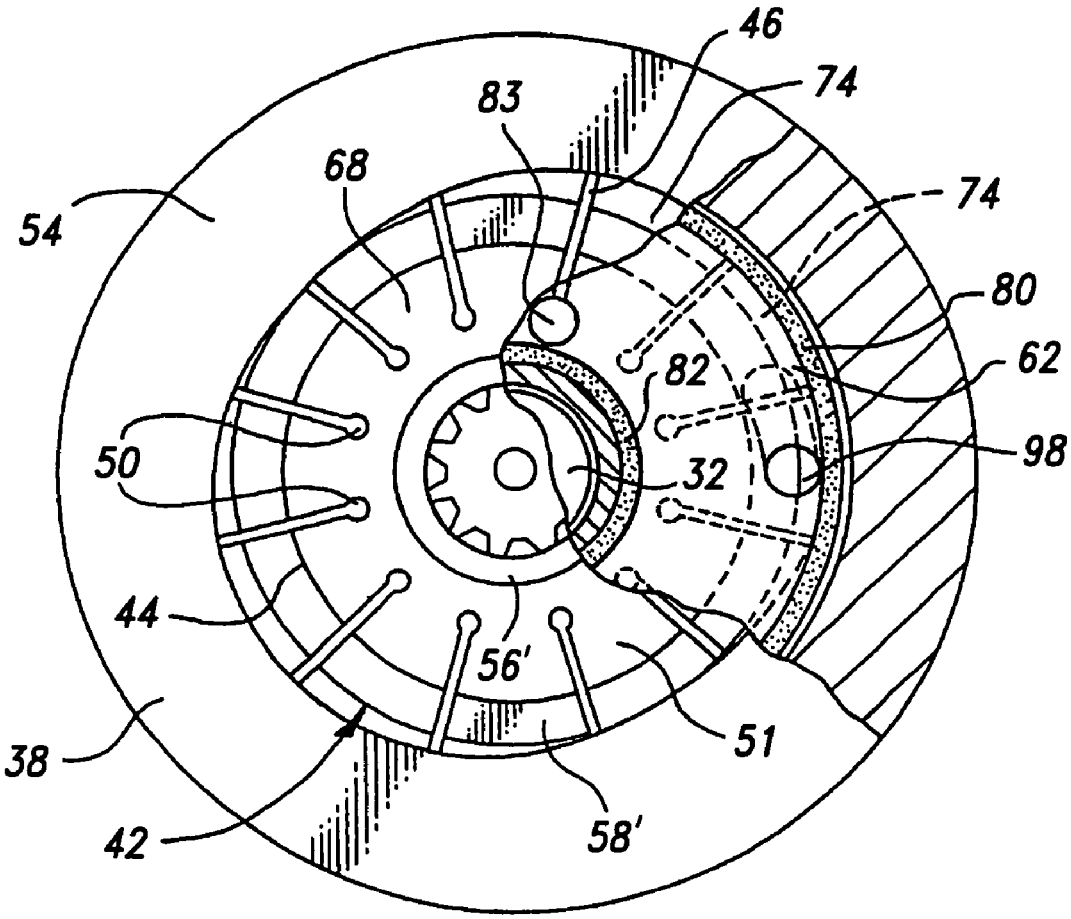
Figure 21:
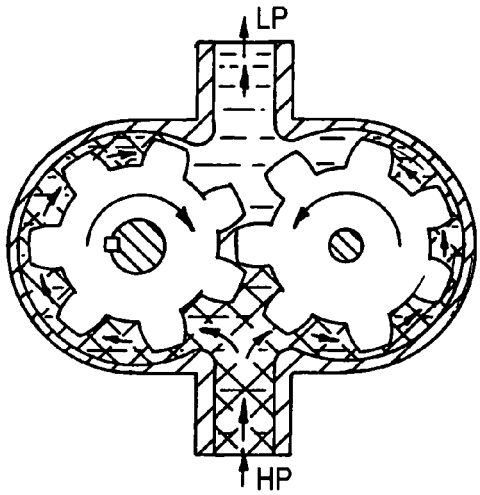
FIG. 21 PRIOR ART
FIGS. 21 thru 21D shown the principal inner working parts of an external gear motor, a direct-drive gerotor motor, an orbiting gerotor motor, a roller-vane gerotor motor and a vane motor respectively, which Figs. are all denoted as "PRIOR ART"
Figure 21A:
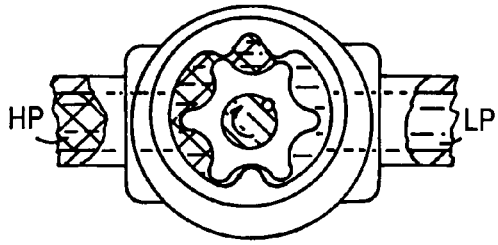
FIG. 21A PRIOR ART
Figure 21B:
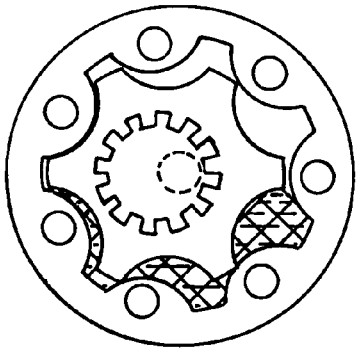
FIG. 21B PRIOR ART
Figure 21C:
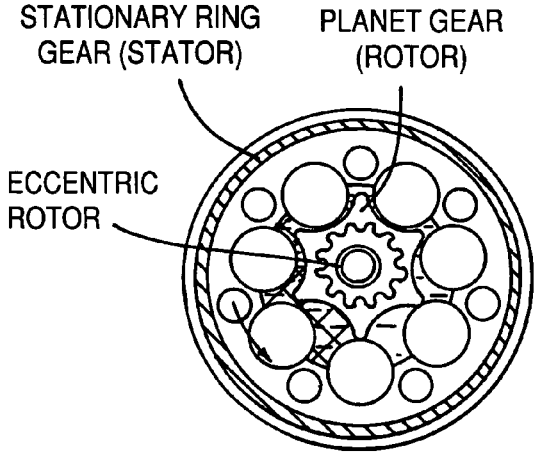
FIG. 21C PRIOR ART
Figure 21D:
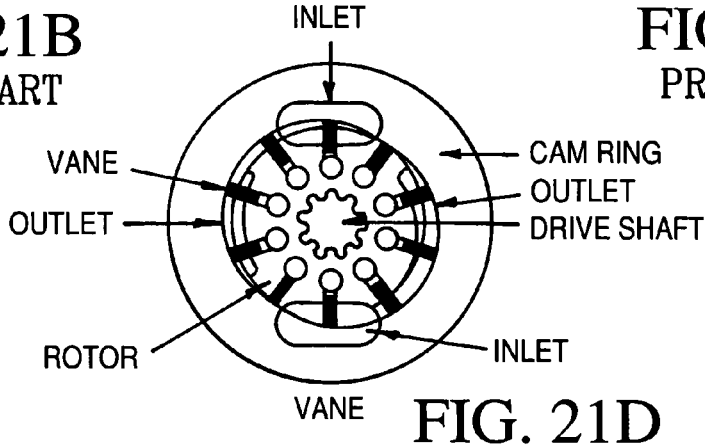
FIG. 21D PRIOR ART
Figure 22:
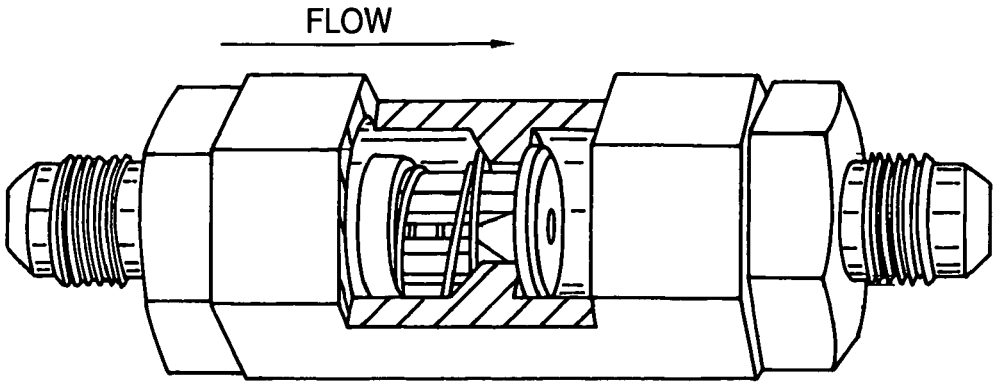
FIG. 22 PRIOR ART
FIG. 22 is a cutaway view of a typical cheek valve useful in the present system.
Figure 23:
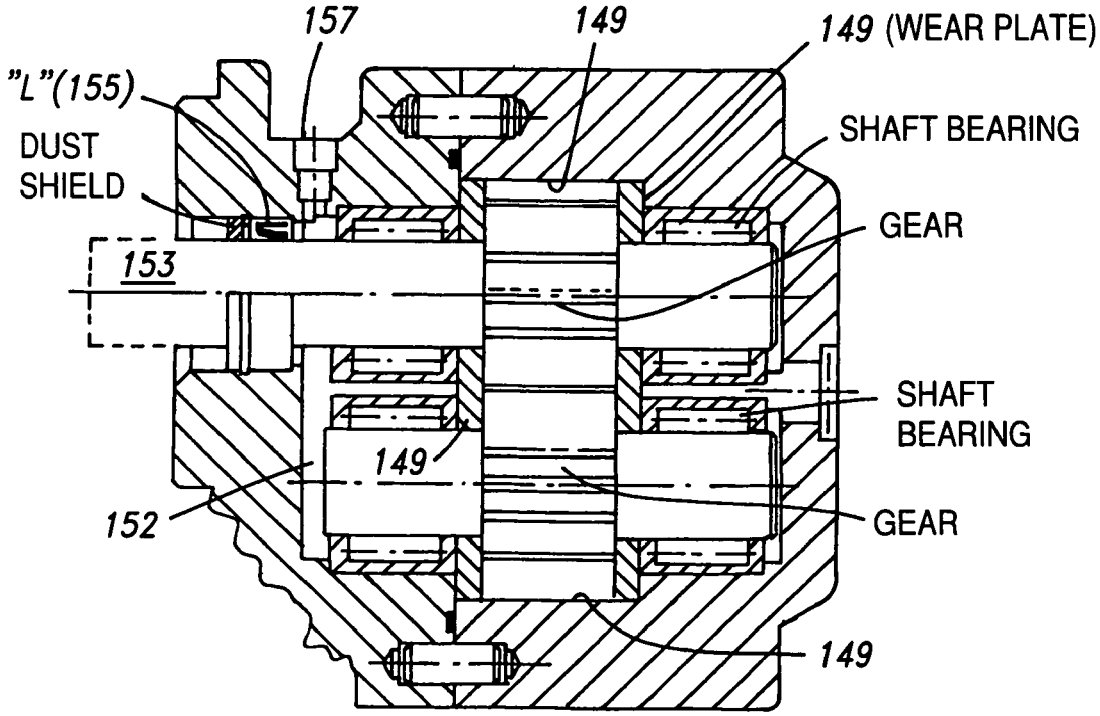
FIG. 23 PRIOR ART
FIG. 23 is a cross-sectional view of a typical hydraulic gear motor useful for the present invention with principal structures thereof denoted.

Referring to FIGS. 13 and 14, the preferred construction for the inverted lip seal 155 is shown as an annular steel rim 158 encapsulating annular steel rings 160 and 162 which separate annular elastomeric seal members 164 and 166. Any number of seal members can be used and they can be configured to provide the needed sealing. When accidental high pressurization of the case cavity 152 accidentally occurs, the seal members 164 and 166 lose their low pressure seats against the shaft as shown in FIG. 13 and blow outwardly as shown by the arrows in FIG. 14 which, of course, ejects hydraulic oil.

Referring to present FIGS. 15, 16, 17, 18, 19 and 20 which are FIGS. 2, 3, 3A, 4, 5 and 6 respectively of U.S. Pat. No. 6,481,990 B2, and the description in columns 3, 4 and 5 of said patent, a representative vane type hydraulic motor is described as follows:

"The hydraulic motor 26 details of which are best shown in FIGS. 2-6, comprises a generally cylindrical shell-like housing 38 which defines a cavity 40 in which a rotor 42 is operatively mounted. More particularly, the rotor is splined or otherwise mounted on the stepped diameter output shaft 32 that has it's innermost end rotatably mounted in bushing 43 or other suitable bearing supported in a mating cylindrical recess 41 in an end cover plate of the motor housing described hereinafter.

The output shaft 32 is further rotatably supported in the housing by a suitable bearing unit 39 axially spaced in the housing from the bushing 43. A main lip seal 45 is mounted in a cylindrical recess in an outer extending cylindrical neck portion of the housing for annular sealing contact with the outer surface the output shaft.

The rotor, drivingly mounted by splines at its centralized inner bore to the output shaft 32, is a generally cylindrical component formed with a circular periphery 44. The periphery is of predetermined width matching the width of flattened, blade-like rotor vanes 46 associated with the rotor. The vanes 46 are operatively mounted in a plurality of generally linear slots 48 that preferably project radially of generally linear slots 48 that preferably project radially in the rotor from a circular arrangement of inner and transversely extending undervane hydraulic passages 50. Other slot arrangements, such as slots that are off center from the axis of rotor rotation may be used as desired.

The passage 50 extend from one side of the rotor to the other to hydraulically connect rotor balancing chambers 51 and 53 formed on opposite sides of the rotor described below. With a hydraulically balanced rotor 42, rotor seizing is reduced or eliminated and motor operating efficiency is increased. When these balancing chamber and the connecting undervane hydraulic passage 50 are pressurized, the pressurized fluid in the undervanes exerts an equal outward force on each of the vanes for effecting the equal operative engagement of each the vane tips with the interior surface 52 of a case ring 54. The cam ring is securely fixed in the housing by dowel pins 55 and surrounds the rotor.

As best shown in FIGS. 3, 4 and 5, the opposite sides of the rotor 42 are formed with preferably concentric inner and outer annular lands 56 and 58 and 56' and 58' that respectively cooperate with the flattened inner faces 60 of a disc-like pressure plate 62 mounted within the housing 38 by dowel pins 55 and the opposing flattened faces 64 of a cover plate cover or end plate 66 that closes the housing. Threaded fasteners such as illustrated by reference numeral 67 in FIG. 2 secure the cover plate to the housing. While O-ring seal 69 provides fluid sealing between these two components. With the cover plate 66 secured to the housing 38, the fluid pressure chambers 51, 53 are formed between the annular lands on opposite sides of the rotor for rotor balancing purposes. Pressure fluid for motor operation is supplied from pump 14 via supply line 22 which connects into a hydraulic fitting 88 on cover plate 66. The fitting connects to the radial passage 90 and transverse leg 92 in the cover plate for feeding high pressure fluid into the rotor balancing chamber and the interconnecting undervanes.

The adjacent reciprocally movable vanes 46 further cooperate with the outer periphery of the rotor and the inner cam surface of the cam ring to define vane pressure chambers 74 in the motor so that the feed of high pressure hydraulic fluid thereto effects rotation of the rotor and thereby the drive of the fan. FIG. 5 for instance, the high pressure of hydraulic fluid supplied to vane chamber 74 exerts a counter clockwise force on the rotor as it flows to the low pressure of the exhaust of the area differential of adjacent vanes defining each vane chamber established by the cam surface as is well known in this art.

Fluid for driving the rotor if fed from high pressure drive chamber 78 (FIG. 3) formed in housing 38 between the pressure plate 62 and the facing end wall of the housing. The radial outer and inner limits of the high pressure chamber 78 are provided by outer and inner seal rings 80 and 82 of elastomer or other suitable material. The high pressure chamber 78 is supplied with pressure fluid by a pair of radially inner passage 83 in the pressure plate 62 for the direct feed of hydraulic from the side rotor balancing chamber 51 into the high pressure drive chamber 78.

As shown in FIG. 3, seal ring 82 is operatively mounted on an inner cylindrical neck 84 of the body of the facing inner wall of the housing and between the pressure plate and the facing inner wall a the housing. The outer sealing ring 80 is mounted between the pressure plate and the facing inner wall of the housing. With the high pressure drive chamber 78 established high pressure fluid is provided for feed through the vane chambers for the drive of the rotor.

Pressure fluid in the high pressure drive chamber is forced through one or more outer radial passages 98 in the fixed pressure plate (FIG. 5) and into the vane chambers 74 as they turn and serially pass such passages. These vane chambers exhaust as they pass arcuate discharge ports 100 cut or otherwise formed in the inner face of the cover plate. Pressure fluid discharged into ports 100 will flow back into low pressure such as provided by the exhaust or return line 24 through the transverse passage 102 and connected radial passage 104 in the cover plate. Passage 104 is connected by fitting 108 to the end portion of the return line 24.

The radial bleed line 109 also formed in the cover plate connects the central opening 41 therein relieves the pressure in the opening for the output shaft 32 to provide relief and protection of the main seal 45 and for the circulating of the hydraulic fluid that act as a lubricating oil for the shaft and bearings.

In FIG. 3A, a modification to the motor primarily involving changes to the pressure plate is disclosed. In this modification the pressure plate 62' is provided with spring biased check valves 112 in the radially inner passage 83' leading to high pressure rotor drive chamber. This check valve construction opens from the force of a predetermined pressure acting on the ball valve element of the check valve for effecting the build up of high pressure in the pressure balancing chambers for improved rotor balancing. Also the increased undervane pressure optimizes "pop out" of the vanes 46 to operatively engage the cam before the high pressure drive chamber 78 is fully charged.

In any event with this invention the motor vanes will be quickly "popped out" in response to the delivery of the high pressure from the pump 14 at a high point on the pressure gradient curve. With such response, the employment of spring devices such as vane springs 116 and their threaded rotor attachment fasteners 117 of FIG. 9 effecting the engagement of the vanes 118 with the cam 120 is not required. Moreover with the present invention, the force applied to each of the vanes is equal so that vane wear is equal for enhanced vane cam ring sealing and increased service life. With the prior vane spring and connections eliminated, unit build is simplified and motor performance is maintained at an optimized level with minimized breakdown."

The invention has been described in detail with particular reference to preferred embodiments thereof, but it will be understood that variations and modifications will be effected with the spirit and scope of the invention.

I claim:

1. A mine dusting machine having a specialized hopper or scoop bucket having a floor, opposite sides and front and rear ends and adapted for carrying substantially free-flowing particulate material, a powered ram on the hopper for pushing said material therein toward said front end, a powered auger conveyor mounted on the hopper adjacent said front end for transporting said material toward said sides of the hopper, separate flingers mounted on said front end at least adjacent each of said sides and adapted to receive material transported to said sides by the conveyor, each said flinger having at least one rotatable blade for dispersing said material with considerable force within the mine, said conveyor means and flingers being powered by separate hydraulic motors which are adapted for connection in series—conveyor motor first—to a pressurized hydraulic feed line, wherein the design operating pressures of said conveyor motors and its output shaft seal are higher than those of said flinger motors such that reverse operation of said motors is to be avoided, each said motor having a case drain port, a hydraulic return line connecting the last flinger motor of the series to a hydraulic reservoir, a primary check valve in said return line for preventing reverse flow therein, a motor case drain line connected into each case drain port of said series and then connected into said return line upstream of the primary check valve, a secondary check valve in said drain line positioned intermediate its conjunction with said return line and the last of said flinger motors of said series for preventing over pressurization of the motor cases and shaft seals in the event of an accidental momentary reverse "HP" flow thru said primary check valve and return line, and wherein a manually operated directional control valve is provided on said machine and connected to said feed and return lines for allowing an operator to direct the flow of high pressure hydraulic fluid to either the feed line or the return line for also running other auxiliary equipment in forward or reverse direction.

2. The system of claim 1 wherein said auger motor operates at pressures of from about 700 to about 1100 psi, a first flinger motor operates at about 400 psi to about 600 psi, and a second flinger motor operates at from about 200 to about 300 psi.

3. The system of claim 1 wherein said the shaft seals of said motors are of the inverted lip seal type.

4. The system of claim 2 wherein said auger motor is a Geroler® type and wherein said flinger motors are of the meshing gear type.

5. A hydraulic system for mining machines which have series connected hydraulically powered bi-directional motors for driving auxiliary equipment, wherein the series comprises a primary motor followed by secondary motors, wherein each motor is constructed with a substantially sealed motor case containing a semi-sealed power unit having an output shaft rotatably mounted thru a shaft seal affixed in a wall portion of said motor case, wherein said primary motor and its shaft seal are designed to operate at much higher pressures than the pressures for the secondary motors and their shaft seals, and whereby the motors run in only one direction in the present system, wherein the seals can blow out under excessive hydraulic pressure in the motor cases, and wherein each case is provided with a case drain port, wherein the hydraulic system has a series connected hydraulic fluid reservoir, a hydraulic fluid pump means, an operator controlled directional control valve having porting means connected to a hydraulic motor feed line and a return line, a first check valve means in said return line for preventing an accidental flow of said high pressure hydraulic fluid in the reverse direction back to the motors, a case drain line connected to each drain port and to said return line downstream of the last motor in the series and upstream of said first check valve means, and second check valve means in said case drain line positioned upstream of said first check valve means and downstream of said last motor for preventing flow of high pressure hydraulic fluid back to the motor case thru the case drain line in the event of a failure of said first check valve means.

* * * * *